US007147285B2

(12) United States Patent
Lin

(10) Patent No.: US 7,147,285 B2
(45) Date of Patent: Dec. 12, 2006

(54) RECLINING APPARATUS FOR CHAIR

(75) Inventor: Yu-Hong Lin, Chayi (TW)

(73) Assignee: Tung Yu Oa Co., Ltd., Chayi (TW)

( * ) Notice: Subject to any disclaimer, the term of this patent is extended or adjusted under 35 U.S.C. 154(b) by 314 days.

(21) Appl. No.: 10/761,095

(22) Filed: Jan. 20, 2004

(65) Prior Publication Data

US 2005/0156453 A1 Jul. 21, 2005

(51) Int. Cl.

| | |
|---|---|
| ***A47C 1/024*** | (2006.01) |
| ***A47C 1/038*** | (2006.01) |
| ***A47C 3/026*** | (2006.01) |
| ***A47C 3/03*** | (2006.01) |

(52) U.S. Cl. ..... 297/301.1; 297/300.1; 297/300.2; 297/300.3; 297/300.4; 297/300.5

(58) Field of Classification Search ..... 297/300.2, 297/300.3, 300.4, 300.5, 300.1, 301.1
See application file for complete search history.

(56) References Cited

U.S. PATENT DOCUMENTS

| | | | | |
|---|---|---|---|---|
| 4,537,445 | A * | 8/1985 | Neuhoff | 297/300.3 |
| 4,640,547 | A * | 2/1987 | Fromme | 297/300.3 X |
| 4,641,886 | A * | 2/1987 | Dauphin | 297/300.3 |
| 4,662,680 | A * | 5/1987 | Dauphin | 297/300.3 |
| 4,747,640 | A * | 5/1988 | Locher | 297/300.3 |
| 4,787,673 | A * | 11/1988 | Locher | 297/300.3 |
| 4,834,453 | A * | 5/1989 | Makiol | 297/300.4 |
| 5,026,117 | A * | 6/1991 | Faiks et al. | 297/300.5 |
| 5,160,184 | A * | 11/1992 | Faiks et al. | 297/300.5 |
| 5,295,731 | A * | 3/1994 | Dauphin | 297/300.1 X |
| 5,601,337 | A * | 2/1997 | Choda et al. | 297/300.2 X |
| 6,276,755 | B1 * | 8/2001 | Su | 297/300.4 X |
| 6,419,320 | B1 * | 7/2002 | Wang | 297/300.3 X |
| 6,523,896 | B1 * | 2/2003 | Uhlenbrock | 297/300.4 |
| 6,588,843 | B1 * | 7/2003 | Ebenstein | 297/300.2 X |
| 6,709,056 | B1 * | 3/2004 | Bock | 297/300.4 |
| 6,840,578 | B1 * | 1/2005 | Su | 297/300.4 X |
| 6,874,853 | B1 * | 4/2005 | Wild | 297/300.2 |
| 6,923,503 | B1 * | 8/2005 | Sangiorgio | 297/300.3 X |
| 2004/0140703 | A1 * | 7/2004 | Bock | 297/300.5 |
| 2005/0184570 | A1 * | 8/2005 | Sanchez | 297/300.3 |

FOREIGN PATENT DOCUMENTS

| | | |
|---|---|---|
| TW | 367759 | 8/1999 |

* cited by examiner

*Primary Examiner*—Rodney B. White
(74) *Attorney, Agent, or Firm*—Alan D. Kamrath; Nikolai & Mersereau, P.A.

(57) ABSTRACT

A reclining apparatus is provided between a post and a seat of a chair. The reclining apparatus includes a first joint for attachment to the post, a second joint pivotally connected with the first joint for supporting the seat and a locking device for locking the second joint in one of several reclined positions relative to the casing.

20 Claims, 10 Drawing Sheets

RECLINING APPARATUS FOR CHAIR

FIELD OF INVENTION

The present invention relates to a chair and, more particularly, to a reclining apparatus for use in a chair.

BACKGROUND OF INVENTION

Referring to FIGS. 10 and 12, a chair is equipped with a conventional reclining apparatus 100 so that the chair can be reclined. The chair includes a base 122, a hydraulic cylinder 119 installed on the base 122, a seat 124 connected with the hydraulic cylinder 119 by the reclining apparatus 100 and a backrest 126 connected with the seat 124.

Referring to FIGS. 12 and 13, the reclining apparatus 100 includes a first joint 113 and a second joint 120 pivotally connected with the first joint 113. The joint 113 defines an aperture 118 for receiving the hydraulic cylinder 119. The second joint 120 is attached to the seat 124. The screw 114 includes a first end inserted through an aperture defined in the first joint 113 and a second end inserted through an aperture defined in the second joint 120. A nut 112 is screwed on the second end of the screw 114. A spring 117 is put around the screw 114. A nut/knob 115 is screwed on the first end of the screw 114. As the seat 124 is reclined relative to the hydraulic cylinder 119, the spring 117 is compressed so as to "counter." The nut/knob 115 can be screwed or unscrewed on the screw 114 so as to adjust the range within which the seat 124 can be reclined relative to the hydraulic cylinder 119. However, the rotation of the nut/knob 115 is exhausting and time-consuming. Hence, a tongue 104 and a crankshaft 103 are used to adjust the range. The tongue 104 is movable into a space between the first joint 113 and the second joint 120 through a window 110 defined in a front plate 128 formed on the second joint 120. The tongue 104 includes a thick portion 106 and a thin portion 107 extending from the thick portion 106. When only the thin portion 107 is between the first joint 113 and the second joint 120, the range is large. When the thick portion 106 is between the first joint 113 and the second joint 120, the range is small. The crankshaft 103 is rotationally mounted on two lugs 108 formed on the front plate 128. The crankshaft 103 includes a first crank 101 and a second crank 102. The first crank 101 is inserted in a lug 105 formed on the tongue 104. The second crank 102 is for abutment against the front plate 128. The rotation of the crankshaft 103 causes the movement of the tongue 104. It is, however, impossible to retain the seat 124 in any reclined position relative to the hydraulic cylinder 119 with the conventional reclining apparatus 100.

The present invention is therefore intended to obviate or at least alleviate the problem encountered in the prior art.

SUMMARY OF INVENTION

It is the primary objective of the present invention to provide a chair with a reclining apparatus that can retain a seat in position relative to a hydraulic cylinder of the chair.

According to the present invention, a reclining apparatus is provided between a post and a seat of a chair. The reclining apparatus includes a first joint for attachment to the post, a second joint pivotally connected with the first joint for supporting the seat and a locking device for locking the second joint in one of several reclined positions relative to the casing.

Other objectives, advantages and novel features of the invention will become more apparent from the following detailed description in conjunction with the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
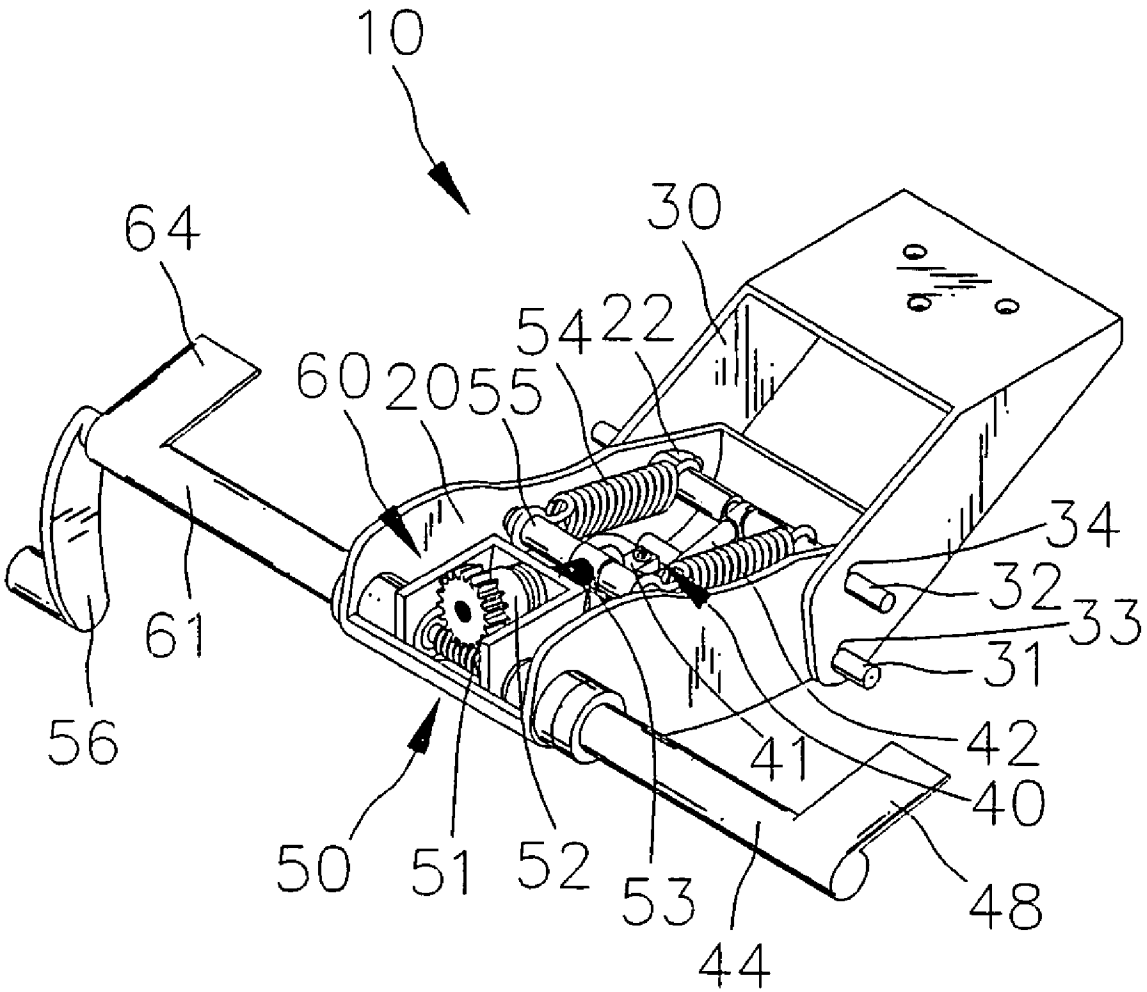
FIG. 1 is a perspective view of a reclining apparatus for use in a chair according to the preferred embodiment of the present invention.
Figure 2:
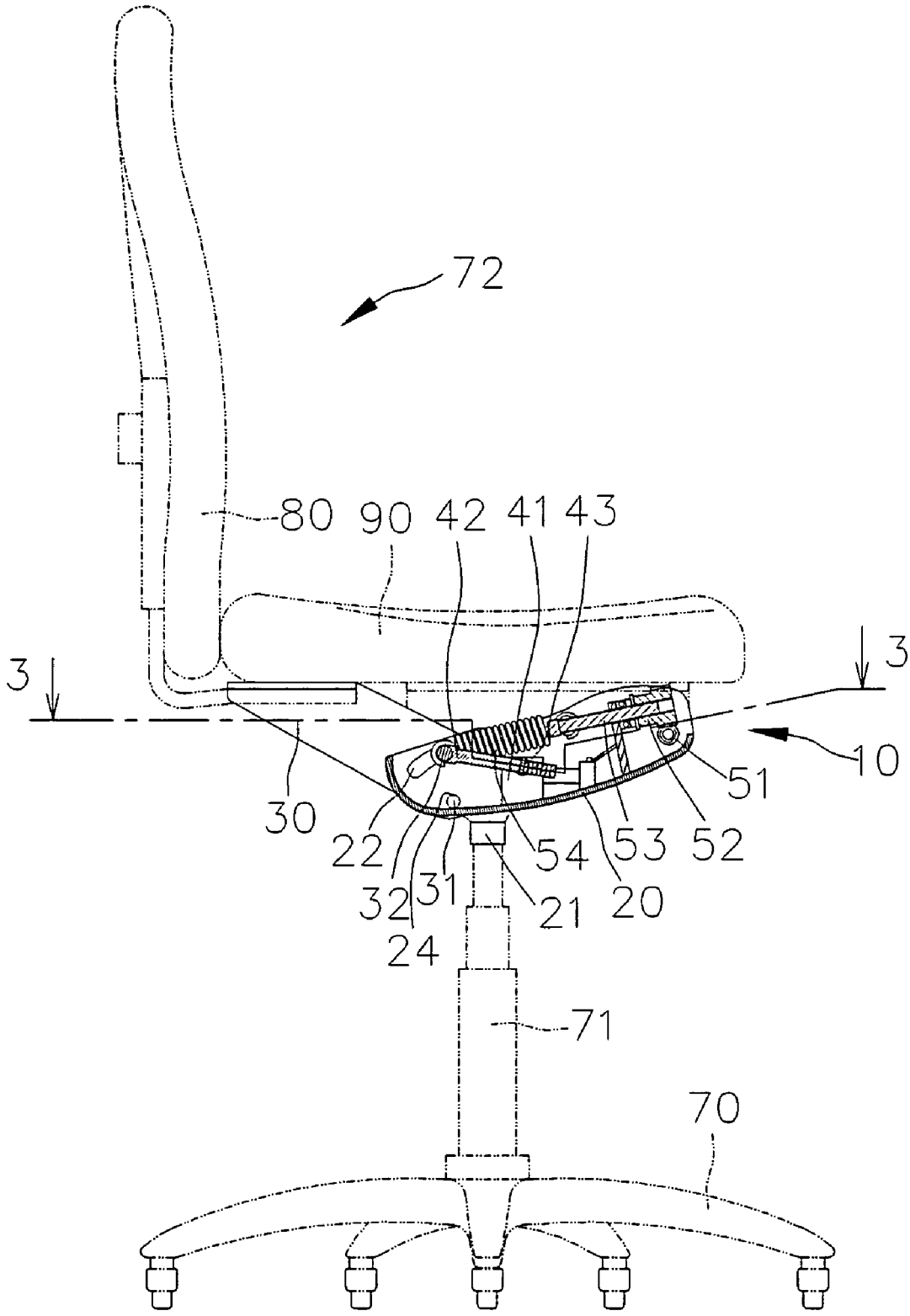
FIG. 2 is a cross-sectional view of the reclining apparatus of FIG. 1, observed from the left.

Referring to FIGS. 1 and 2, a reclining apparatus 10 is used in a chair 72. The chair 72 includes a base 70 for installment on the ground, a hydraulic cylinder 71 installed on the base 70, a seat 90 connected with the hydraulic cylinder 71 via the reclining apparatus 10 and a backrest 80 installed on the seat 90. The seat 90 can be reclined relative to the hydraulic cylinder 71 and kept in the reclined position by the reclining apparatus 10.

The reclining apparatus 10 includes a first joint 20 for attachment to the hydraulic cylinder 71, a second joint 30 pivotally connected with the first joint 20 for supporting the seat 90, a locking device 40 for locking the second joint 30 in one of several reclined positions relative to the first joint 20, a tuning device 50 for tuning the reclined positions of the second joint 30 relative to the first joint 20 and a lifting device 60 for controlling the hydraulic cylinder 71.

The first joint 20 is in the form of a casing. The casing 20 includes a bottom and two lateral walls. An aperture 21 is defined in the bottom of the casing 20. The hydraulic cylinder 71 is inserted into the casing 20 through the aperture 21. An arched slot 22 and an aperture 24 are defined in each lateral wall of the casing 20.

The second joint 30 is in the form of a bracket. The bracket 30 includes a top member for supporting the seat 90 and two lateral members extending from the top member. Two apertures 33 and 34 are defined in each lateral member of the bracket 30. A pin 31 is inserted in the apertures 33 of the bracket 30 and the apertures 24 of the casing 20. Another pin 32 is inserted in the apertures 34 of the bracket 30 and the arched slots 22 of the casing 20. Thus, the bracket 30 is pivotally connected with the casing 20.

Figure 3:
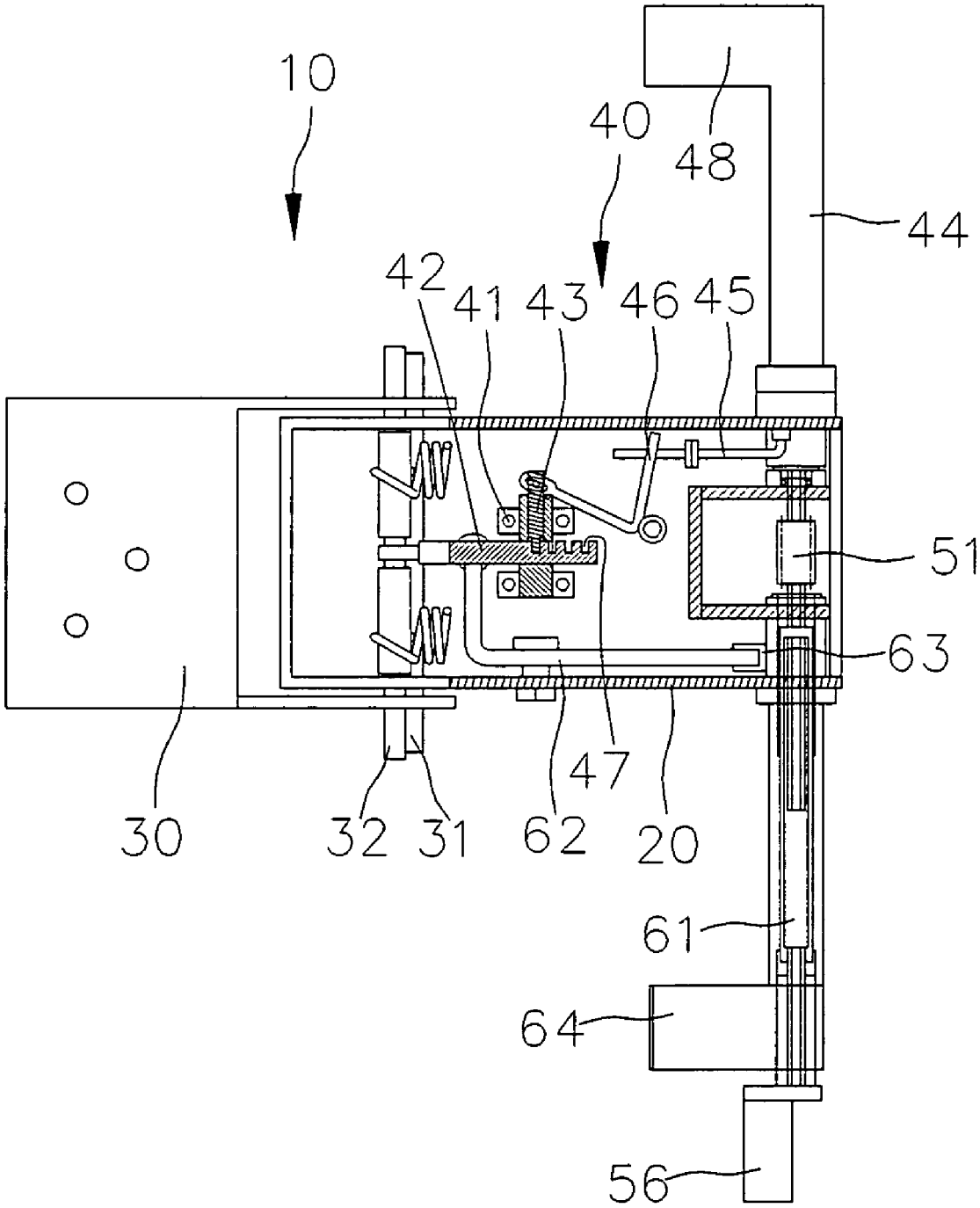
FIG. 3 is a cross-sectional view taken along a line 3—3 in FIG. 2.

Referring to FIG. 3, the locking device 40 includes a mount 41 installed on the bottom of the casing 20. A rod 42 is movably installed on the mount 41. The rod 42 is connected with the pin 32 at an end and defines several dents 47 near an opposite end. A latch 43 is movably installed on the mount 41. The rod 42 and the latch 43 are movable in transverse directions so that the latch 43 can enter the dents 47. As the latch 43 enters a selective one the dents 47, the bracket 30 is locked in selective one of several reclined positions relative to the casing 20. A V-shaped lever 46 is pivotally installed on the bottom of the casing 20. The V-shaped lever 46 includes a first end linked to the latch 43 and a second end connected with a link 45. The link 45 is further connected with a shaft 44. The shaft 44 is rotationally installed on the lateral walls of the casing 20. A handle 48 extends transversely from the shaft 44.

Figure 4:
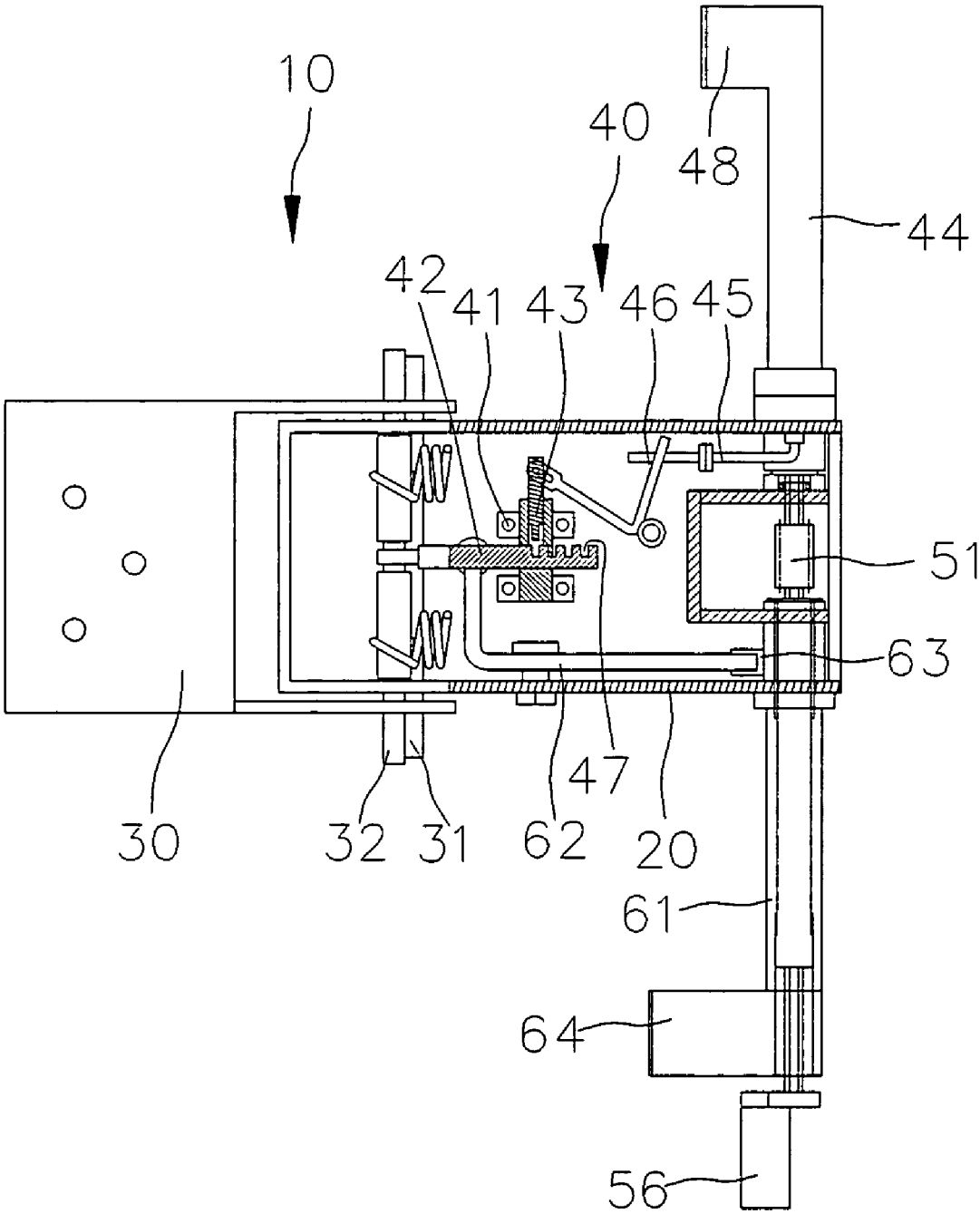
FIG. 4 is similar to FIG. 3 but shows the reclining apparatus in a different position.

Referring to FIGS. 3 and 4, pivotal movement of the handle 48 causes rotation of the shaft 44. The rotation of the shaft 44 causes movement of the link 45. The movement of the link 45 causes pivotal movement of the V-shaped lever 46. The pivotal movement of the V-shaped lever 46 causes the movement of the latch 43 into and from the dents 47.

Referring to FIG. 2, the tuning device 50 includes two springs 54 connected with the pin 32. The springs 54 are further connected with a bar 55. The bar 55 is further connected with a screw 53. The screw 53 is further engaged with a nut/gear 52. The nut/gear 52 is further engaged with a worm 51. The worm 51 is rotationally installed on the lateral walls of the casing 20. A crank 56 extends from the worm 51.

Figure 5:
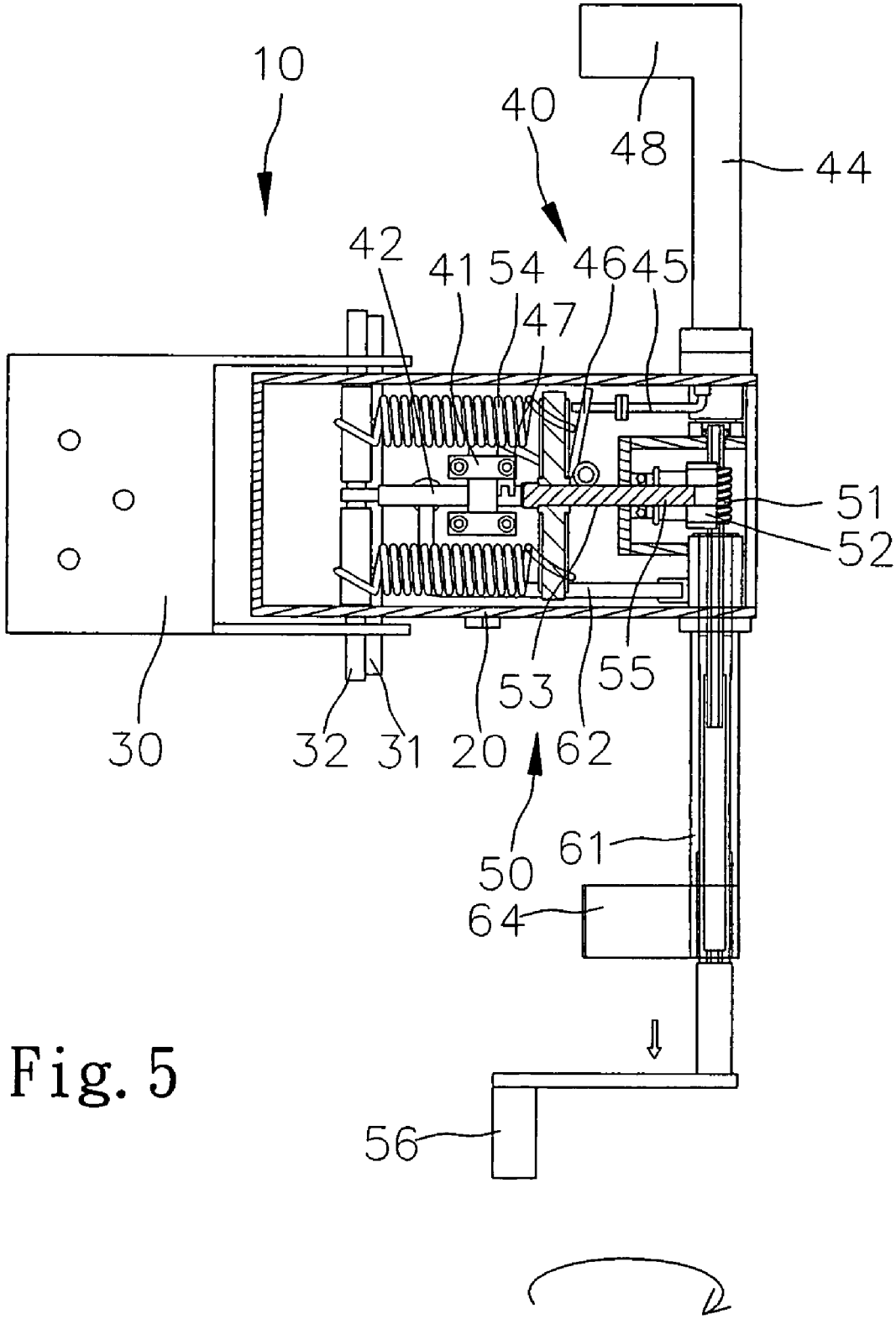
FIG. 5 is similar to FIG. 4 but shows the reclining apparatus in a different position.
Figure 6:
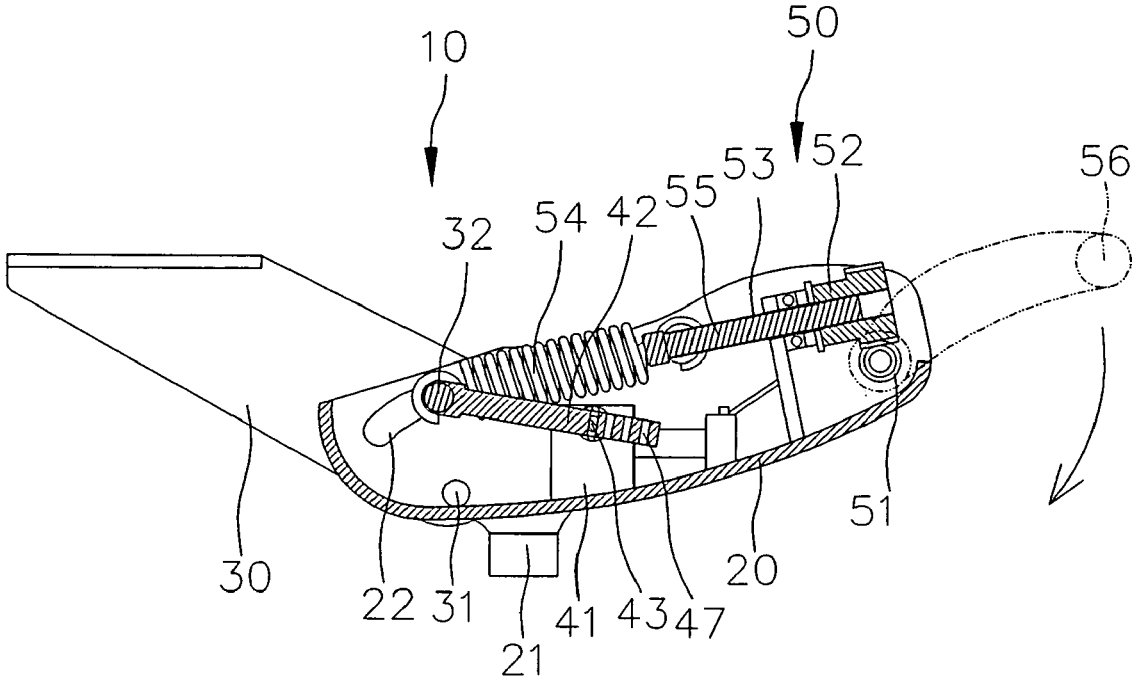
FIG. 6 is similar to FIG. 2 but shows the reclining apparatus in a different position.
Figure 7:
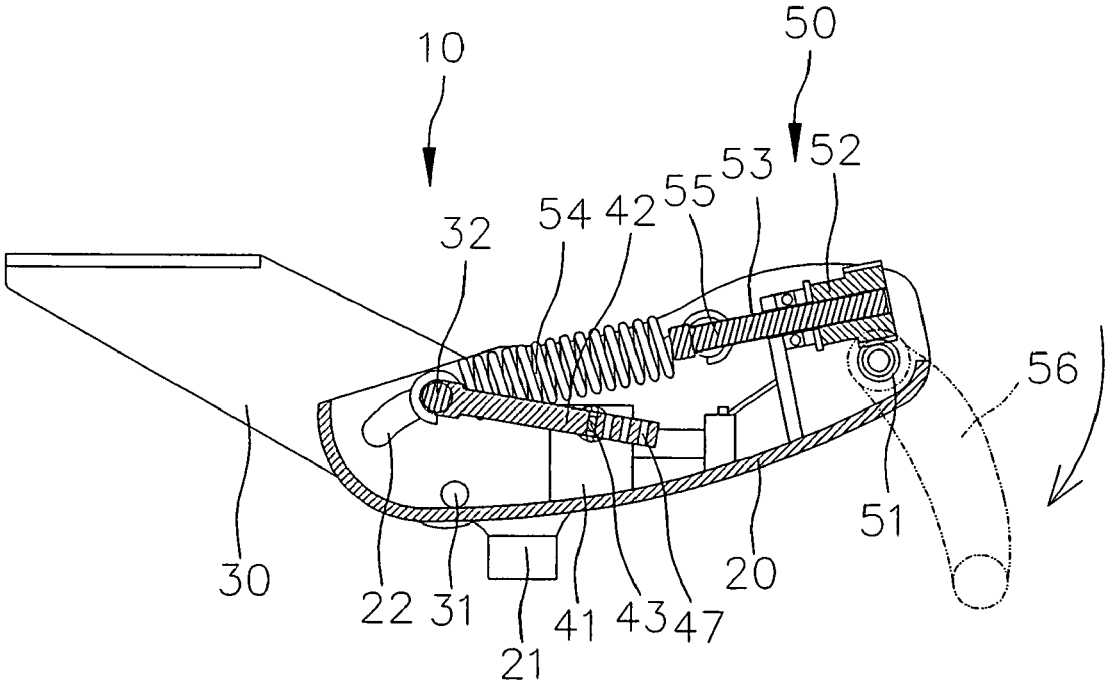
FIG. 7 is similar to FIG. 6 but shows the reclining apparatus in a different position.

Referring to FIGS. 5–7, rocking of the crank 56 causes rotation of the worm 51. The rotation of the worm 51 causes rotation of the nut/gear 52. The rotation of the nut/gear 52 causes movement of the screw 53. The movement of the screw 53 causes movement of the bar 55. The movement of the bar 55 causes movement of the springs 54. Through the pin 32, the movement of the springs 54 causes pivotal movement of the rod 42 about the latch 43 and therefore the reclining of the seat 90 relative to the hydraulic cylinder 71.

Referring to FIG. 3, the lifting device 60 includes an L-shaped lever 62 with a first section and a second section extending transversely from the first section. The first section of the L-shaped lever 62 is for contact with the hydraulic cylinder 71. The second section of the lever 62 is pivotally installed on one of the lateral walls of the casing 20. The second section of the L-shaped lever 62 is further in contact with a tab 63 extending transversely from a shaft 61. The shaft 61 is rotationally installed on the lateral walls of the casing 20. A handle 64 extends transversely from the shaft 61.

Figure 8:
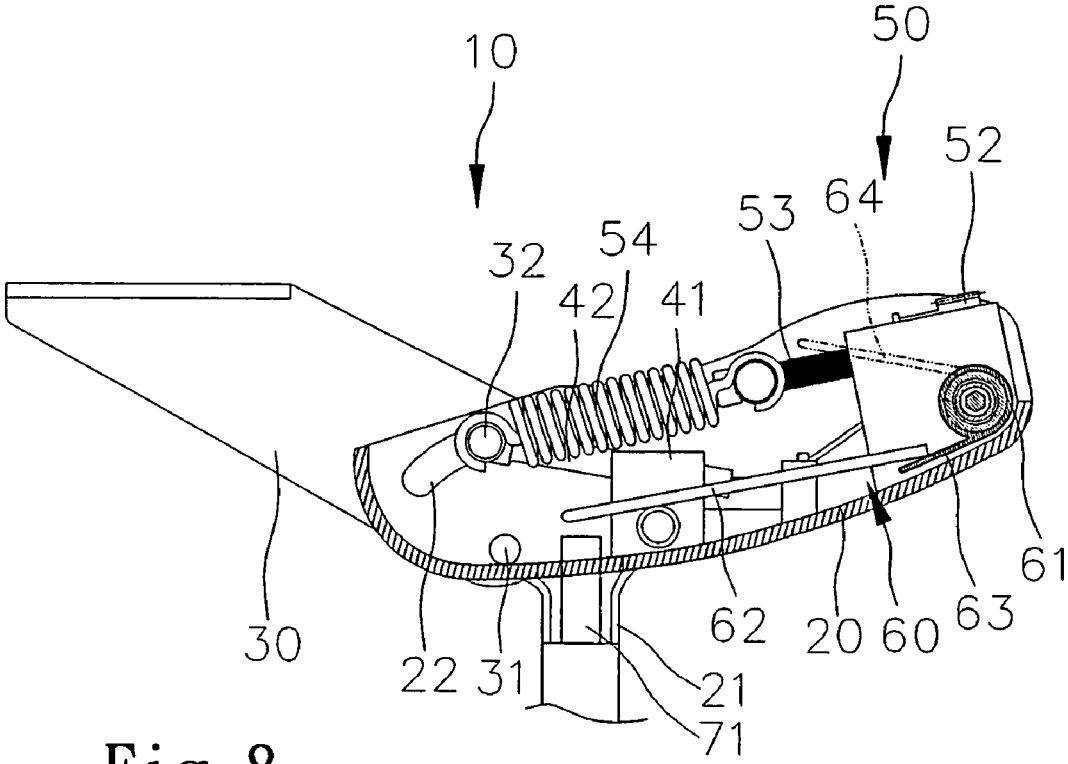
FIG. 8 is similar to FIG. 7 but shows the reclining apparatus in a different position.
Figure 9:
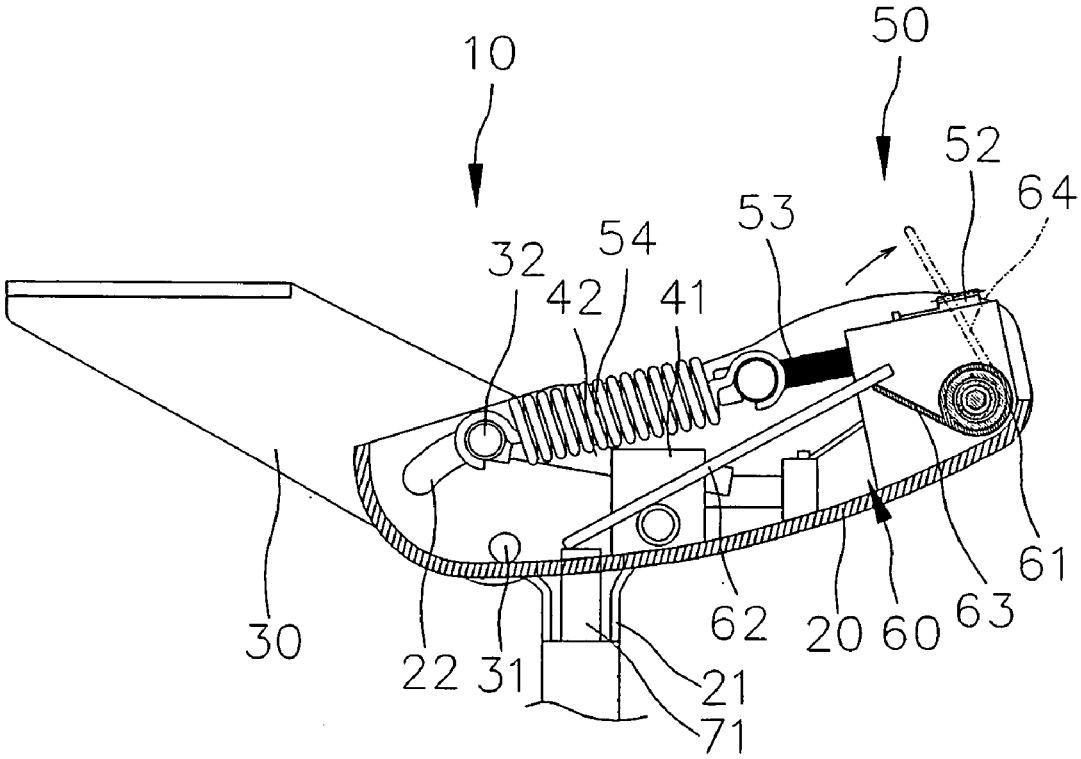
FIG. 9 is similar to FIG. 8 but shows the reclining apparatus in a different position.
Figure 10:
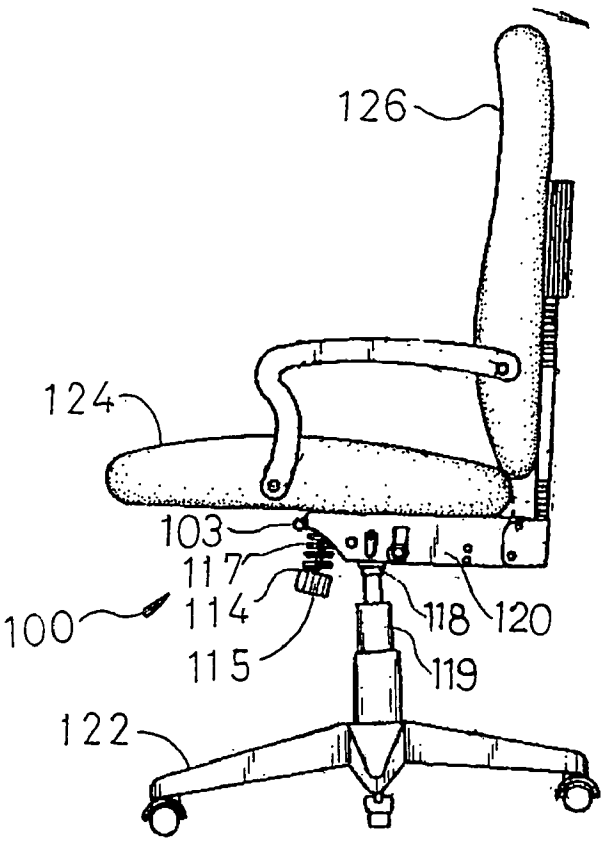
Fig. 10 PRIOR ART
FIG. 10 is a right side view of a chair equipped with a conventional reclining apparatus.
Figure 11:
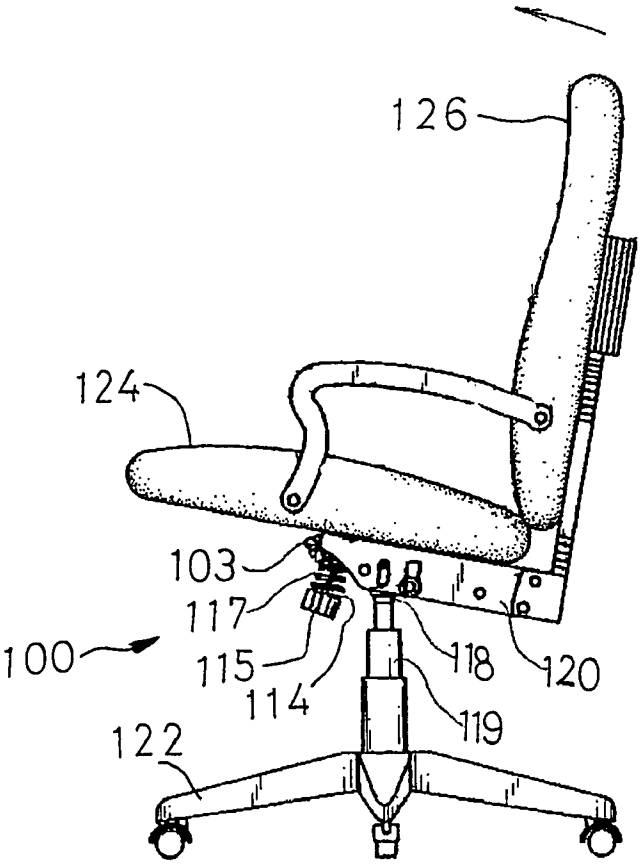
Fig. 11 PRIOR ART
FIG. 11 is similar to FIG. 10 but shows the chair equipped in a different position.
Figure 12:
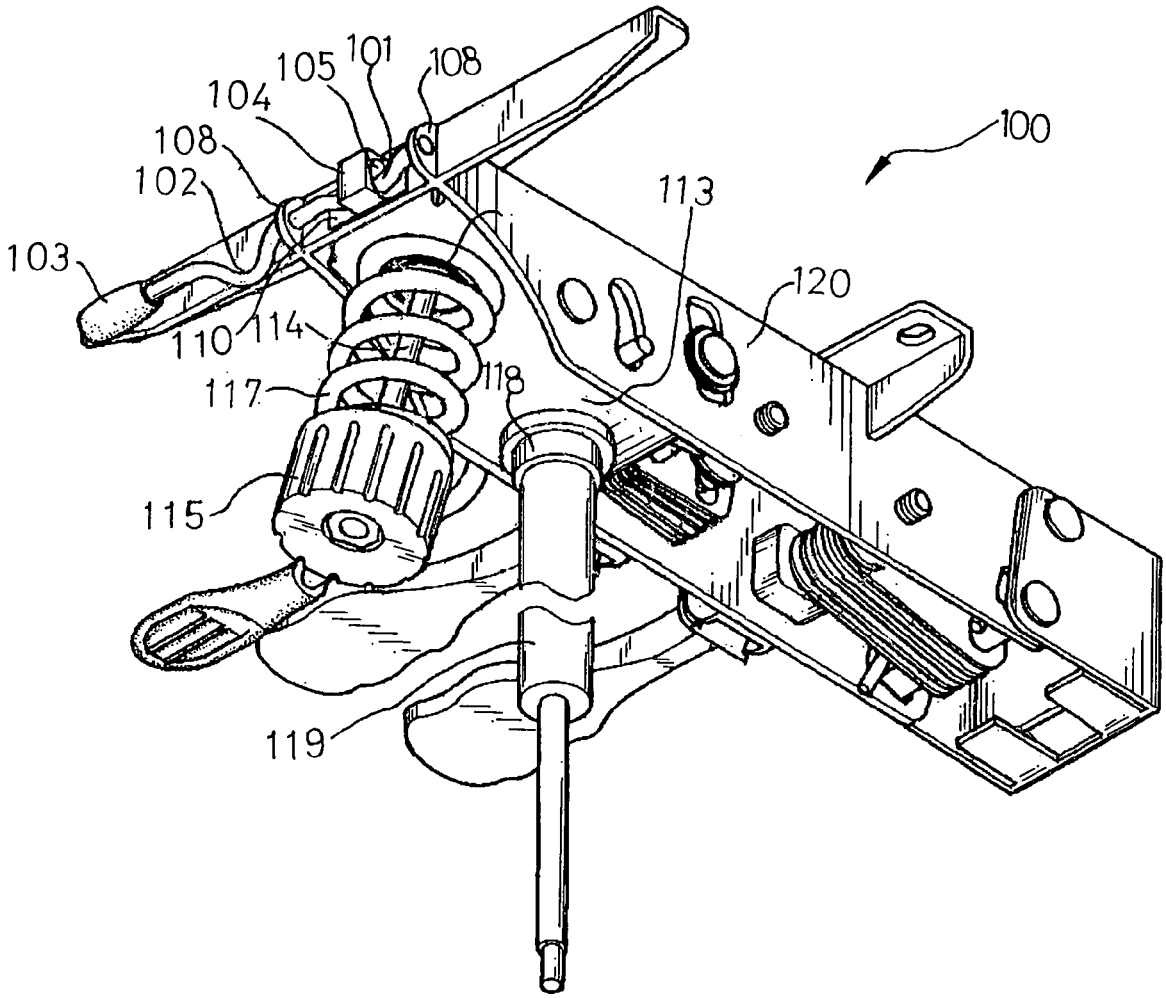
Fig. 12 PRIOR ART
FIG. 12 is a perspective view of the conventional reclining apparatus of FIG. 10.
Figure 13:
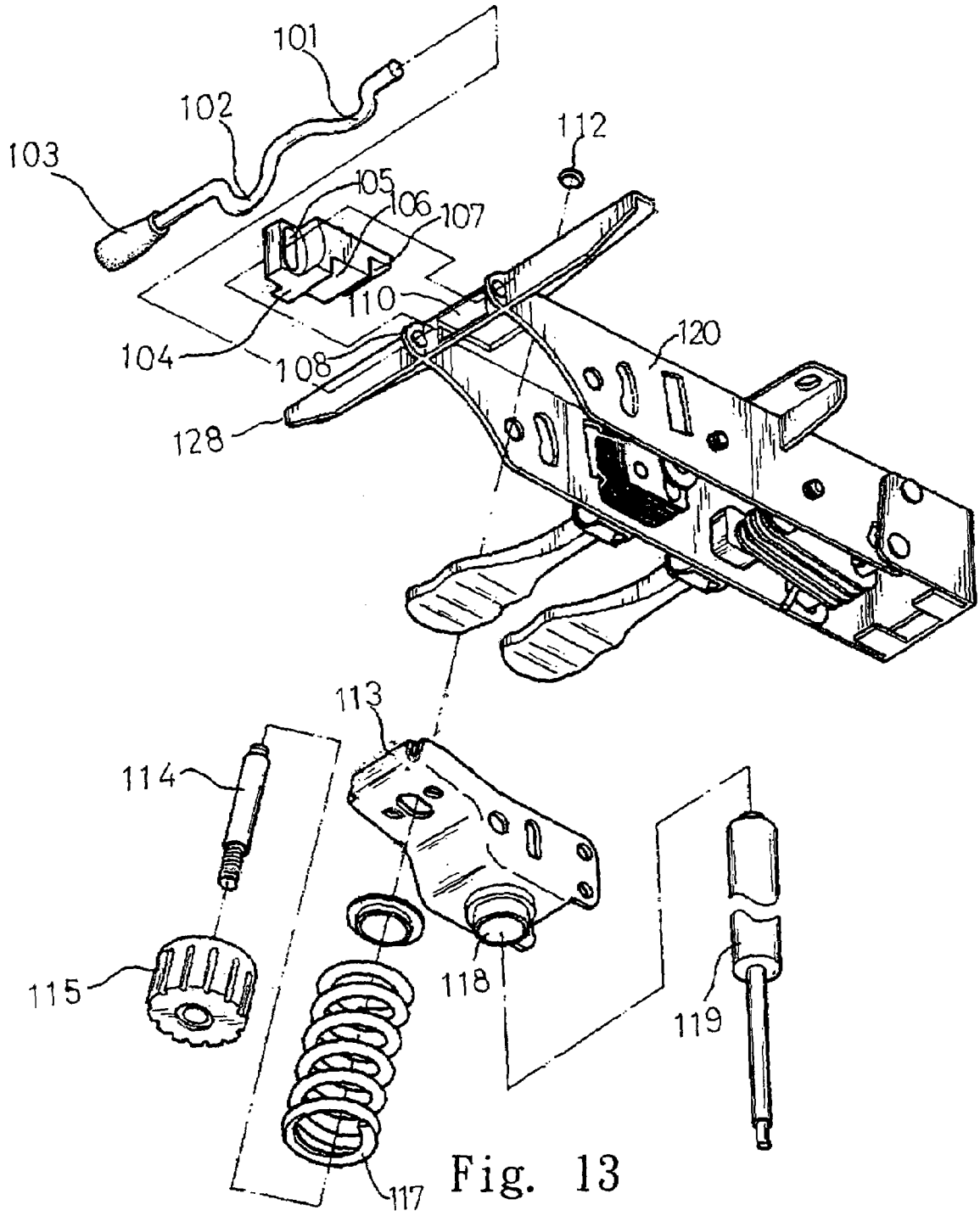
Fig. 13 PRIOR ART
FIG. 13 is an exploded view of the conventional reclining apparatus of FIG. 12.

Referring to FIGS. 8 and 9, pivotal movement of the handle 64 causes rotation of the shaft 61. The rotation of the shaft 61 causes pivotal movement of the tab 63. The pivotal movement of the tab 63 causes pivotal movement of the second section of the L-shaped lever 62. The pivotal movement of the second section of the L-shaped lever 62 causes movement of the first section of the L-shaped lever 62. The movement of the first section of the L-shaped lever 62 results in operation of the hydraulic cylinder 71.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A reclining apparatus for use between a post and a seat of a chair, the reclining apparatus comprising:

a first joint for attachment to the post;

a second joint pivotally connected with the first joint and for supporting the seat;

a locking device for locking the second joint in one of several reclined positions relative to the first joint, wherein the locking device includes:

a rod connected with the second joint and movable on the first joint, the rod defines several dents; and a latch movable on the first joint between a releasing position where the latch is away from the rod and a locking position where the latch is in one of the dents so as to lock the seat in one of the several reclined positions relative to the post; and a spring connected between the first joint and the rod.

2. The reclining apparatus according to claim 1 wherein the rod and the latch are movable in transverse directions.

3. The reclining apparatus according to claim 1 wherein the locking device includes a mount installed on the first joint, and the rod is movably installed on the mount.

4. The reclining apparatus according to claim 1 wherein the locking device includes a handle for maneuvering the latch.

5. The reclining apparatus according to claim 4 wherein the locking device includes a linkage connected between the latch and the handle.

6. The reclining apparatus according to claim 5 wherein the linkage includes a shaft connected with the latch, and the handle extends transversely from the shaft.

7. The reclining apparatus according to claim 6 wherein the linkage includes a V-shaped lever pivotal on the first joint, and the V-shaped lever includes a first end linked to the latch and a second end linked to the shaft.

8. The reclining apparatus according to claim 7 wherein the linkage includes a link connected between the shaft and the second end of the V-shaped lever.

9. The reclining apparatus according to claim 1 including a pin connected between the second joint and the rod generally perpendicular to the rod, with the spring connected to the pin and the first joint.

10. The reclining apparatus according to claim 9 wherein the first joint defines two arched slots for receiving two ends of the pin.

11. A reclining apparatus for use between a post and a seat of a chair, the reclining apparatus comprising:

a first joint for attachment to the post;

a second joint pivotally connected with the first joint and for supporting the seat;

a locking device for locking the second joint in one of several reclined positions relative to the first joint wherein the locking device includes:

a rod connected with the second joint and movable on the first joint, the rod defines several dents, and a latch movable on the first joint between a releasing position where the latch is away from the rod and a locking position where the latch is in one of the dents so as to lock the seat in one of the several reclined positions relative to the post; and a pin connected between the second joint and the rod, wherein the first joint defines two arched slots for receiving two ends of the pin.

12. The reclining apparatus according to claim 11 including a pin for pivotally connecting the second joint with the first joint.

13. The reclining apparatus according to claim 11 including a tuning device for tuning the reclined positions of the second joint.

14. The reclining apparatus according to claim 11 wherein the post is a hydraulic cylinder.

15. The reclining apparatus according to claim 14 including a lifting device for controlling the hydraulic cylinder.

16. The reclining apparatus according to claim 15 wherein the lifting device includes a lever pivotally installed on the first joint, and the lever includes a first end for contact with the hydraulic cylinder and a second end to be maneuvered.

17. The reclining apparatus according to claim 16 wherein the lifting device includes a shaft rotationally installed on the lateral walls of the first joint and connected with the second end of the lever.

18. A reclining apparatus for use between a post and a seat of a chair, the reclining apparatus comprising a first joint for attachment to the post, a second joint pivotally connected with the first joint and for supporting the seat, a locking device for locking the second joint in one of several reclined positions relative to the first joint and a tuning device for tuning the reclined positions of the second joint, wherein the tuning device includes at least one spring connected with the second joint; a screw connected with the spring and non-rotationally installed on the first joint; a nut engaged with the screw and rotationally installed on the first joint so that screwing of the nut on the screw causes pivotal movement of the second joint relative to the first joint; and a worm rotationally installed on the first joint, and wherein the nut is a nut/gear engaged with the screw internally and engaged with the worm externally.

19. The reclining apparatus according to claim 18 wherein the tuning device includes a crank extending transversely from the worm.

20. The reclining apparatus according to claim 1 further comprising:

a screw connected with the spring and non-rotationally installed on the first joint; and a nut engaged with the screw and rotationally installed on the first joint so that screwing of the nut on the screw causes pivotal movement of the second joint relative to the first joint.

* * * * *